US011530501B1

(12) United States Patent
Podhajny et al.

(10) Patent No.: US 11,530,501 B1
(45) **Date of Patent: *Dec. 20, 2022**

(54) TUBULAR WARP KNIT SPACER FABRIC

(71) Applicant: Apple Inc., Cupertino, CA (US)

(72) Inventors: Daniel A. Podhajny, San Jose, CA (US); Yohji Hamada, Wakayama (JP)

(73) Assignee: Apple Inc., Cupertino, CA (US)

( * ) Notice: Subject to any disclaimer, the term of this patent is extended or adjusted under 35 U.S.C. 154(b) by 386 days.

This patent is subject to a terminal disclaimer.

(21) Appl. No.: 15/947,679

(22) Filed: Apr. 6, 2018

Related U.S. Application Data

(60) Provisional application No. 62/567,118, filed on Oct. 2, 2017.

(51) Int. Cl.
*D04B 27/08* (2006.01)
*D04B 23/18* (2006.01)
(Continued)

(52) U.S. Cl.
CPC ..... *D04B 27/08* (2013.01); *D04B 21/06* (2013.01); *D04B 21/202* (2013.01); *D04B 23/18* (2013.01);
(Continued)

(58) Field of Classification Search
CPC ..... D04B 27/08; D04B 23/18; D04B 21/202; D04B 21/06; D04B 37/06; D04B 35/04;
(Continued)

(56) References Cited

U.S. PATENT DOCUMENTS 3,570,268 A 3/1971 Nogues
4,949,386 A * 8/1990 Hill ..... H04R 1/026 181/149
(Continued)

FOREIGN PATENT DOCUMENTS

DE 20100915 * 5/2001 ..... A61N 1/16
WO WO-9526698 A1 * 10/1995 ..... A61F 13/00063
WO WO-2006015599 A1 * 2/2006 ..... A61F 13/04

OTHER PUBLICATIONS

Mesh definition, Textile Glossary, Celanese Acetate 2001 (Year: 2001).*

*Primary Examiner* — Jennifer A Steele
(74) *Attorney, Agent, or Firm* — Treyz Law Group, P.C.; G. Victor Treyz; Kendall P. Woodruff

(57) ABSTRACT

A warp knitting system may knit a seamless tube of fabric. The fabric may have a spacer between outer and inner fabric layers. The knitting system may have first and second needle guide systems. The first and second needle guide systems may each have selectively linked needle bed sections that guide respective needles. A guide bar system may have guide bars that dispense strands of material during knitting. Each guide bar may be positioned using a respective guide bar positioner. The guide bar system may be shifted relative to the needles using a rotational positioner. The needle guide systems and guide bar system may be formed from selectively coupled links. The selectively coupled links may be configured to adjust the diameter of the tube of fabric to a desired value. The thickness of the tube may be adjusted by adjusting a gap between the first and second needle guide systems.

20 Claims, 18 Drawing Sheets

(51) Int. Cl.

| | |
|---|---|
| ***D04B 35/04*** | (2006.01) |
| ***D04B 21/20*** | (2006.01) |
| ***D04B 21/06*** | (2006.01) |
| ***D04B 37/06*** | (2006.01) |
| *D04B 1/22* | (2006.01) |

(52) U.S. Cl.
CPC ..... *D04B 35/04* (2013.01); *D04B 37/06* (2013.01); *D04B 1/225* (2013.01); *D04B 21/205* (2013.01)

(58) Field of Classification Search
CPC ..... D04B 1/225; D04B 21/205; D10B 2403/0333; D10B 2403/02431; D10B 2401/18
See application file for complete search history.

(56) References Cited

U.S. PATENT DOCUMENTS

| | | | | |
|---|---|---|---|---|
| 6,389,850 | B1 | 5/2002 | Fujiwara | |
| 7,240,522 | B2 | 7/2007 | Kondou et al. | |
| 7,347,011 | B2 | 3/2008 | Dua et al. | |
| 9,154,866 | B2 * | 10/2015 | Bibl | H04R 1/1041 |
| 9,304,736 | B1 * | 4/2016 | Whiteley | G06Q 20/40145 |
| 10,427,374 | B2 * | 10/2019 | Hamada | B32B 27/08 |
| 10,995,433 | B1 * | 5/2021 | Bergeron | A41H 3/007 |
| 2002/0157429 | A1 * | 10/2002 | Matsumoto | D04B 21/10 66/195 |
| 2004/0176658 | A1 * | 9/2004 | McMurray | A61F 2/2481 600/37 |
| 2008/0264110 | A1 | 10/2008 | Sinykin | |
| 2010/0315299 | A1 * | 12/2010 | Bibl | H04R 1/1033 343/702 |
| 2012/0091112 | A1 * | 4/2012 | Wei | H05B 3/342 219/202 |
| 2012/0255201 | A1 | 10/2012 | Little | |
| 2013/0087462 | A1 * | 4/2013 | Rabe | C25D 17/10 66/196 |
| 2014/0273699 | A1 * | 9/2014 | Zhang | F16L 53/38 442/316 |
| 2016/0345086 | A1 * | 11/2016 | Chamberlin | H04R 1/028 |
| 2017/0006374 | A1 * | 1/2017 | Song | F16H 35/18 |
| 2017/0106622 | A1 * | 4/2017 | Bonin | B32B 5/06 |
| 2018/0272644 | A1 * | 9/2018 | Hamada | B32B 7/12 |
| 2019/0069078 | A1 * | 2/2019 | Johnson | H04R 1/345 |

* cited by examiner

TUBULAR WARP KNIT SPACER FABRIC

This patent claims the benefit of provisional patent application No. 62/567,118, filed on Oct. 2, 2017, which is hereby incorporated by reference herein in its entirety.

FIELD

This relates generally to fabric and, more particularly, to systems for forming warp knit fabric and devices that include warp knit fabric.

BACKGROUND

It may be desirable to form voice-controlled assistant devices, bags, covers for electronic devices such as cellular telephones and tablet computers, and other equipment from fabric. Fabric-based items such as these may have an attractive appearance and may benefit from desirable attributes associated with fabric such as sound permeability, light weight, and durability.

In some arrangements, knit fabric may have an appearance and other attributes that are preferred over woven fabric. It may be easier and faster to produce warp knit fabric than weft knit fabric, so applications involving knit fabric often rely on warp knit fabric.

It can be challenging, however, to produce warp knit fabric with desired characteristics.

SUMMARY

A fabric-based item such as an electronic device having a housing covered with fabric may include a seamless tube of warp knit fabric. A warp knitting system may knit the seamless tube of fabric. The fabric may have a spacer between outer and inner fabric layers. The fabric may be used as a covering for an electronic device, may be used as part of a bag or enclosure, or may form a portion of other fabric-based items.

The knitting system may have first and second needle guide systems. The needle guide systems may each have needle bed sections that guide respective needles. Each needle may have a positioner that is individually adjustable. A guide bar system may have guide bars that dispense strands of material during knitting. Each guide bar may be positioned using a respective guide bar positioner. During knitting, the guide bar system may be shifted relative to the needles using a rotational positioner.

The needle guide systems and guide bar system may be formed from selectively coupled sections. The selectively coupled sections may be configured to adjust the diameters of the guide bar systems and the needle guide systems and thereby adjust the diameter of the tube of fabric to a desired value. The thickness of the tube may be adjusted by adjusting a gap between the first and second needle guide systems. Other aspects of the fabric tube such as the cross-sectional profile of the tube and bends in the tube along the tube's longitudinal axis may also be adjusted by controlling the warp knitting process.

DETAILED DESCRIPTION

Figure 1:
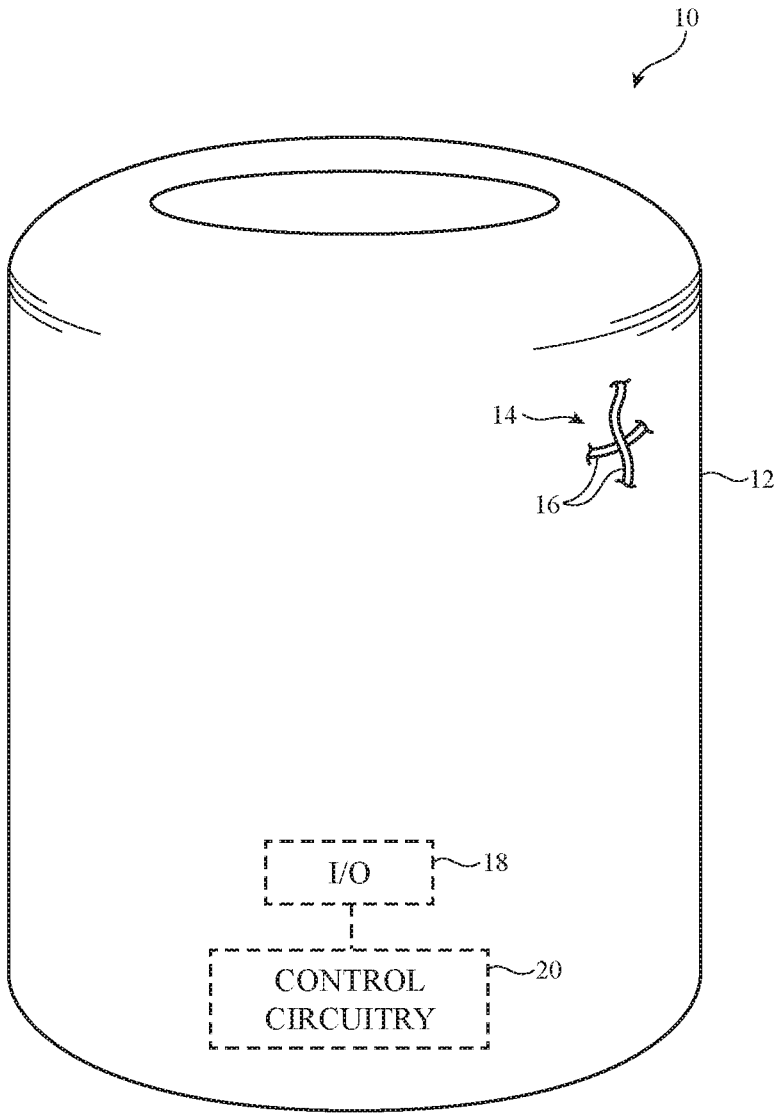
FIG. 1 is a perspective view of an illustrative fabric-based item such as a voice-controlled electronic device having a housing covered with a fabric layer in accordance with an embodiment.

Items such as item 10 of FIG. 1 may be based on fabric. Item 10 may be an electronic device or an accessory for an electronic device such as a voice-controlled electronic device (sometimes referred to as a digital assistant or voice-controlled speaker), a laptop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which fabric-based item 10 is mounted in a kiosk, in an automobile, airplane, or other vehicle, other electronic equipment, or equipment that implements the functionality of two or more of these devices. If desired, item 10 may be a removable external case for electronic equipment, may be a strap, may be a wrist band or head band, may be a removable cover for a device, may be a case or bag that has straps or that has other structures to receive and carry electronic equipment and other items, may be a necklace or arm band, may be a wallet, sleeve, pocket, or other structure into which electronic equipment or other items may be inserted, may be part of a chair, sofa, or other seating (e.g., cushions or other seating structures), may be part of an item of clothing or other wearable item (e.g., a hat, belt, wrist band, headband, shirt, pants, shoes, etc.), or may be any other suitable fabric-based item. In the illustrative configuration of FIG. 1, item 10 is a voice-controlled electronic device such as a voice-controlled speaker with internet access. Other types of device may incorporate fabric, if desired.

As shown in FIG. 1, item 10 may include a housing such as housing 12. Housing 12 may have a cylindrical shape of the type shown in FIG. 1 or other suitable shape (e.g., a pyramidal shape, a conical shape, a box shape such as a rectangular box shape, a spherical shape, etc.). Housing 12 may include support structures formed from metal, polymer, ceramic, glass, wood, other materials, and/or combinations of these materials. Item 10 may include fabric 14. Fabric 14 may form all or part of a housing wall or other layer in an electronic device, may form internal structures in an electronic device, or may form other fabric-based structures. Item 10 may be soft (e.g., item 10 may have a fabric surface that yields to a light touch), may have a rigid feel (e.g., the surface of item 10 may be formed from a stiff fabric), may be coarse, may be smooth, may have ribs or other patterned textures, and/or may be formed as part of a device that has portions formed from non-fabric structures of plastic, metal, glass, crystalline materials, ceramics, or other materials. For example, some or all of the upper surface of housing 12, the sidewall surfaces of housing 12, surfaces associated with lower portions of housing 12, and/or other portions of item 10 may be covered with fabric 14. In some configurations, fabric 14 may serve as a cosmetic cover for item 10 that is permeable to sound.

Fabric 14 may include intertwined strands of material such as strands 16. Fabric 14 may, for example, be warp knit fabric that is formed by warp knitting of strands 16. Strands 16 may be single-filament strands (sometimes referred to as fibers or monofilaments) or may be strands of material formed by intertwining multiple monofilaments of material together (sometimes referred to as yarns).

Strands 16 may be formed from polymer, metal, glass, graphite, ceramic, natural materials such as cotton or bamboo, or other organic and/or inorganic materials and combinations of these materials. Conductive coatings such as metal coatings may be formed on non-conductive material. For example, plastic strands in fabric 14 may be coated with metal to make them conductive. Reflective coatings such as metal coatings may be applied to make strands reflective. Strands may be formed from bare metal wires or metal wire intertwined with insulating monofilaments (as examples). Bare metal strands and strands of polymer covered with conductive coatings may be provided with insulating polymer jackets.

Items such as item 10 may, if desired, include control circuitry 20. Control circuitry 20 may include microprocessors, microcontrollers, application-specific integrated-circuits, digital signal processors, baseband processors, and/or other controllers and may include storage such as random-access memory, read-only memory, solid state drives, and/or other storage and processing circuitry.

Control circuitry 20 may gather information from sensors and other circuitry in input-output devices 18 and may use input-output devices 18 to supply output. Input-output devices 18 may, for example, include audio devices such as microphones and speakers. Microphones can gather audio input (e.g., sound that passes through fabric 14). Speakers can produce audio output (e.g., sound that passes through fabric 14). Sensors in input-output devices 18 may include touch sensors, force sensors, capacitive sensors, optical sensors, proximity sensors, strain gauges, temperature sensors, moisture sensors, gas sensors pressure sensors, magnetic sensors, position and orientation sensors (e.g., accelerometers, gyroscopes, and/or compasses), and/or other sensors. Light-emitting diodes, displays, and other visual output devices may be used in supply visual output to a user. Buttons, joysticks, haptic output components, and/or other input-output components may be provided in input-output devices 18 to gather input from a user and to provide a user with output. Wireless circuitry in circuitry 20 (e.g., wireless local area network circuitry, cellular telephone circuitry, etc.) may be used to support wireless communications with external equipment.

Integrated circuits and other electrical components forming circuitry 20 and/or input-output devices 18 may be mounted in housing 12. Fabric 14 may cover the exterior of housing 12 (e.g., to hide electrical components in housing 12 from view). Fabric 14 may also be used in forming structural portions of housing 12 and/or other portions of item 10, may be used in forming straps, covers, wearable items, and/or other structures for items 10.

Figure 2:
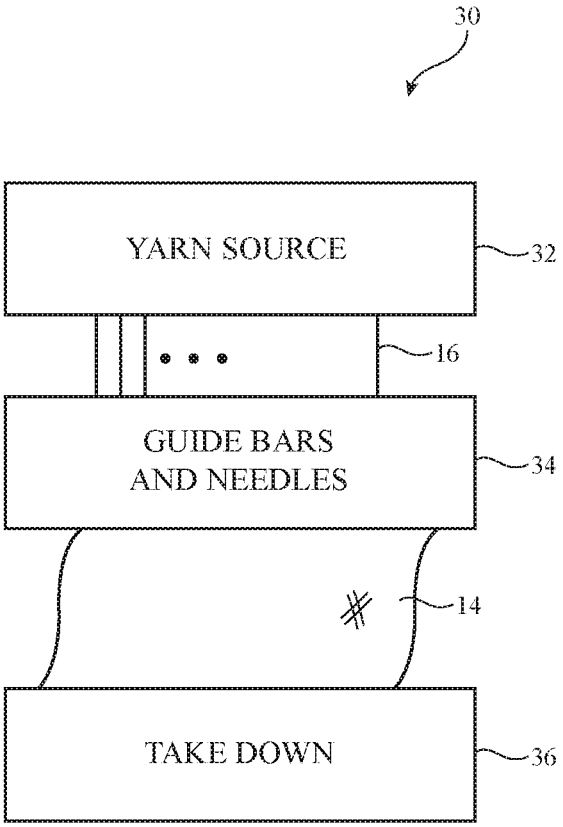
FIG. 2 is a schematic diagram of an illustrative warp knitting system in accordance with an embodiment.

A warp knitting machine or other equipment may be used in forming fabric 14 from strands 16. FIG. 2 is a schematic diagram of an illustrative warp knitting system. As shown in FIG. 2, yarn source 32 in warp knitting system 30 may be used in supplying strands 16 to guide and needle structures 34. Structures 34 may include strand guide structures (e.g., a system of movable guide bars with eyelets that guide strands 16) and needle systems (e.g., needle guide systems that guide sets of individually adjustable needles so that the needles may interact with the strands dispensed by the guide bars). During operations, a controller may control electrically adjustable positioners in system 30 to manipulate the positions of guide bars and needles in system 30 and thereby knit strands 16 into fabric 14. Take down 36 (e.g., a pair of mating rollers or other equipment forming a take down system) may be used to gather fabric 14 that is produced during knitting.

Figure 3:
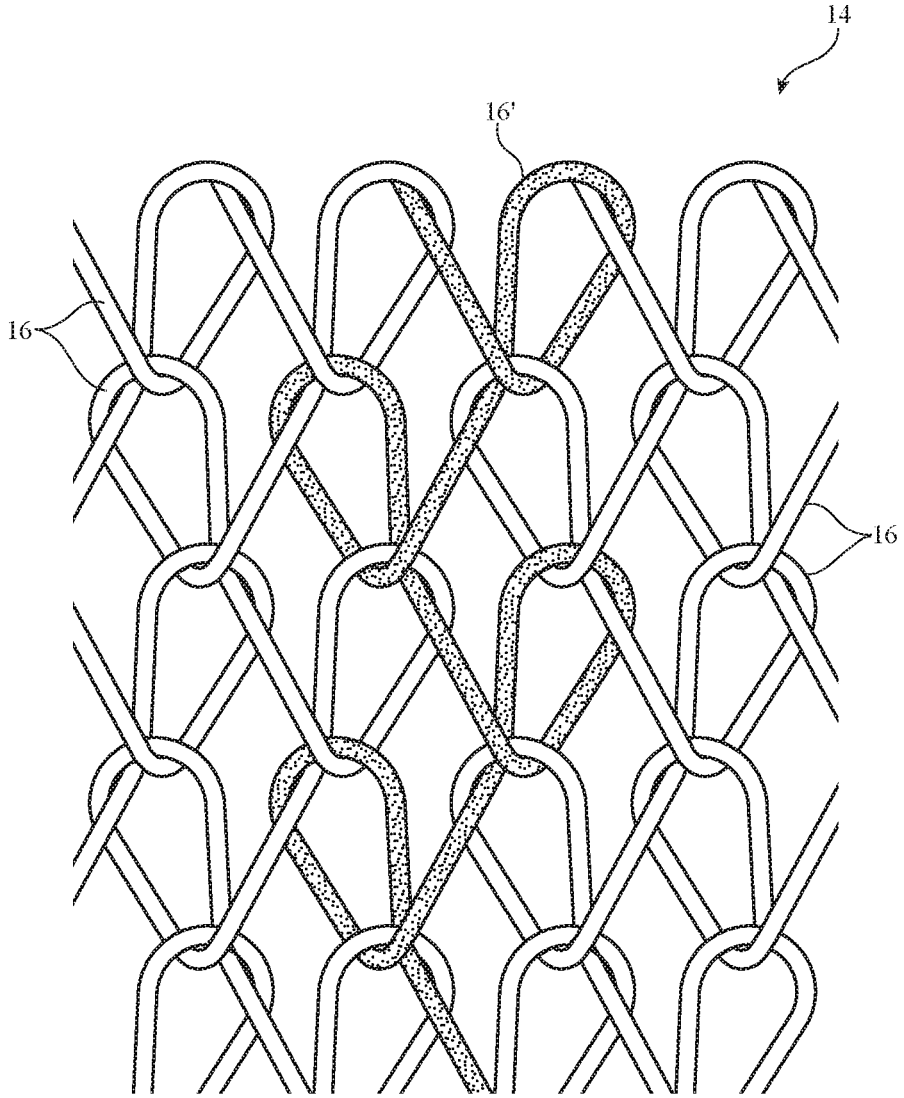
FIG. 3 is a diagram of a portion of an illustrative layer of warp knit fabric in accordance with an embodiment.

A layer of illustrative warp knit fabric 14 is shown in FIG. 3. An illustrative strand 16' among strands 16 has been highlighted to show the zig-zag path taken by each strand in fabric 14.

Figure 4:
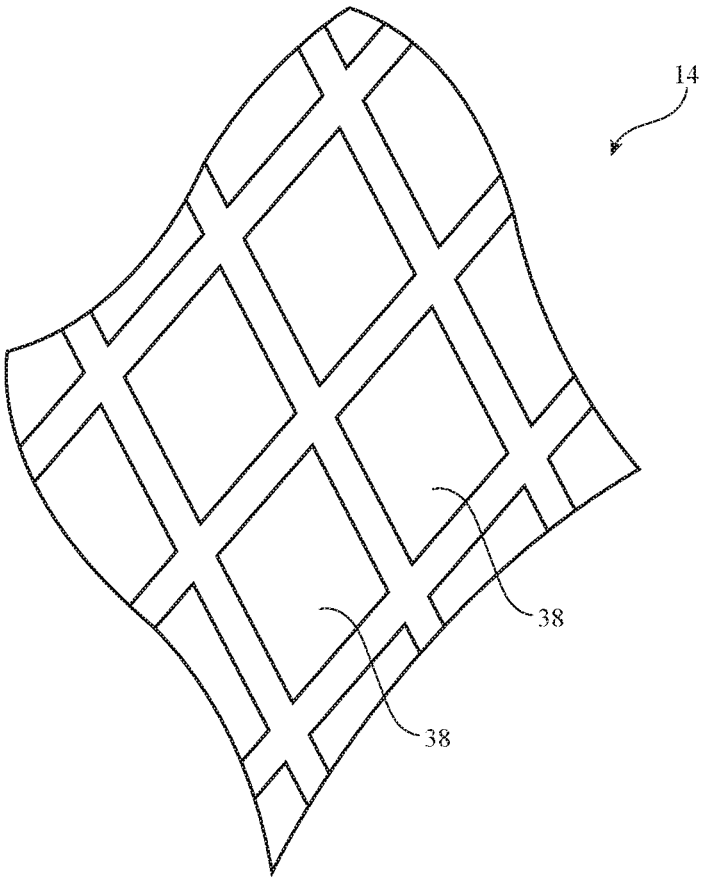
FIG. 4 shows how a layer of fabric may have openings such as diamond-shaped openings in accordance with an embodiment.

During knitting, control circuitry in system 30 may direct electrically adjustable positioners in system 30 to knit fabric 16 with any suitable warp knit pattern. As an example, control circuitry in system 30 may use the electrically adjustable positioners to knit fabric 16 that includes diamond-shaped openings or openings of other suitable shapes, as illustrated by openings 38 in warp knit fabric 14 of FIG. 4.

Figure 5:
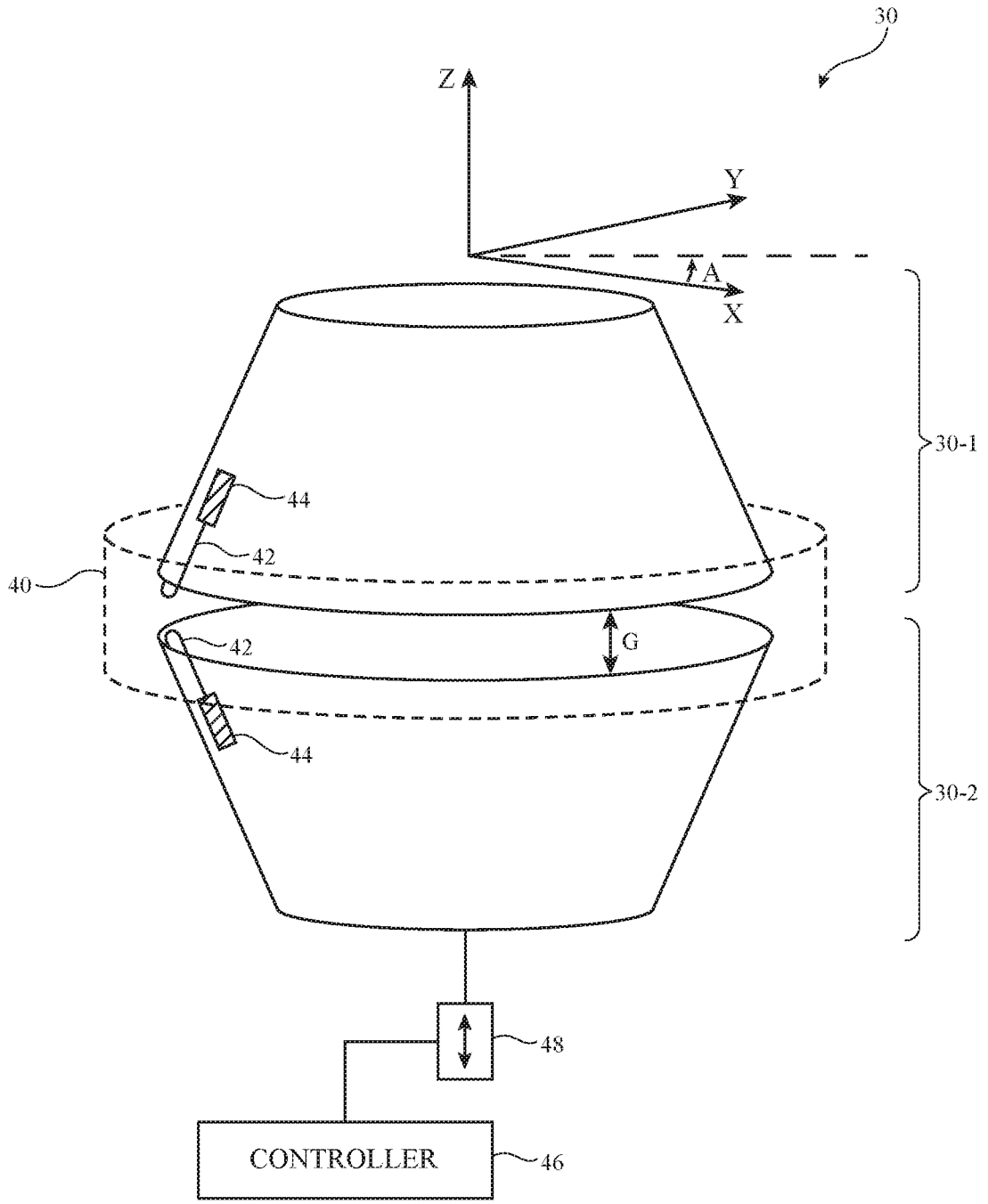
FIG. 5 is a perspective view of an illustrative warp knitting system in accordance with an embodiment.

FIG. 5 is a perspective view of an illustrative warp knitting system. As shown in FIG. 5, warp knitting system may have first portion 30-1 and second portion 30-2. Portions 30-1 and 30-2 may have first and second support structures (first and second needle guide systems) for respectively supporting first and second sets of needles 42. These support structures, which may sometimes be referred to as needle beds, needle guide structures, needle guides, or needle systems, may have conical shapes as shown in FIG. 5 (e.g., to help avoid interference between opposing needles 42) or may have other suitable shapes, (e.g., cylindrical shapes, cylindrical shapes with planar inserted sections, etc.). Portion 30-1 may support any suitable numbers of needles 42 around its periphery (e.g., 10s of needles, 100s of needles, or more). As an example, portion 30-1 may support 100-400 needles, at least 50 needles, at least 200 needles, fewer than 500 needles, etc. Portion 30-2 may support the same number of needles 42 as portion 30-1 (as an example). Only a single needle 42 is shown on portion 30-1 and only a single needle 42 is shown on portion 30-2 to avoid over-complicating the diagram.

Guide bar system 40, which may sometimes be referred to as a strand guide system, yarn guide system, guide bar system, or strand guiding system, may include a series of guide bars that are used in providing needles 42 with strands 16. Needles 42 may be moved using electrically adjustable positioners 44. The guide bars may be positioned using adjustable guide bar positioners. Guide bar system 40 may also be rotated about axis Z relative to portions 30-1 and/or 30-2 by an adjustable rotational angle A using a rotational positioner. The separation (gap G) between portions 30-1 and 30-2 can be adjusted by moving portions 30-1 and 30-2 relative to each other along axis Z (e.g., using a positioner such as electrically adjustable longitudinal axis positioner 48, which can be used in adjusting the position of portion 30-2 along axis Z (e.g., the longitudinal axis of system 30).

The positioners in system 30 such as positioners 44 for positioning needles 42 and the guide bar positioners in guide bar system 40 may be controlled dynamically by control circuitry such as controller 46. Each needle 42 may have a respective individually adjustable positioner 44 to provide system 30 with Jacquard capabilities and/or sets of two or more needles 42 may be adjusted together (e.g., to reduce the number of individually adjustable positioners that are used). In some configurations, for example, all of needles 42 on portion 30-1 may be adjusted together and all of needles 42 on portion 30-2 may be adjusted together. The ability of each of positioners 44 to be independently controlled by controller 46 allows each of needles 42 to be moved independently, thereby allowing fabrics with a variety of different designs to be formed.

Figure 6:
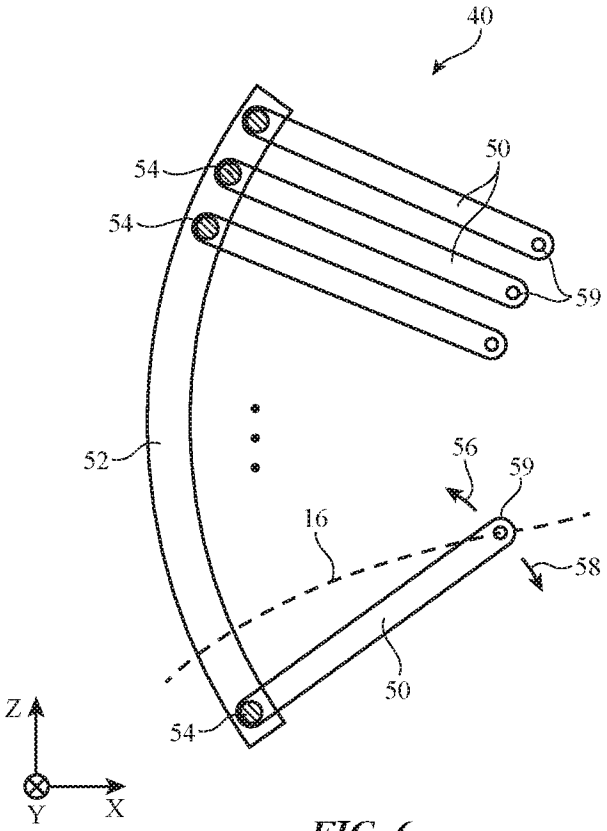
FIG. 6 is a side view of an illustrative adjustable guide system for a warp knitting system in accordance with an embodiment.

FIG. 6 is a cross-sectional side view of a portion of guide bar system 40 taken at a particular location around the periphery of system 30 (e.g., in the X-Z plane of FIG. 5). As shown in FIG. 6, at each angular position (e.g., each needle position) around the periphery of system 30, guide bar system 40 may have a set of multiple guide bars 50 supported using guide bar support structure 52. Each guide bar 50 may have an eyelet 59. Strands 16 may pass through eyelets 59. During operation, the position of eyelets 59 and therefore strands 16 may be adjusted dynamically (e.g., to wrap strands 16 about desired needles 42, etc.).

There may be N pairs of needles 42 at N different angular locations (values of angle A) around the Z axis and N corresponding sets of guide bars 50. There may be 2-16 guide bars 50 in each set of guide bars 50, 4-12 guide bars 50 in each set, 8-16 guide bars 50 in each set, at least 4 guide bars 50 in each set, at least 8 guide bars 50 in each set, fewer than 16 guide bars 50 in each set, etc. Each guide bar 50 may be coupled to a respective electrically adjustable guide bar positioner 54. By adjusting the guide bar positioner for a given guide bar, the angular orientation of that guide bar within its plane of rotation may be adjusted. For example, a guide bar may be moved upwards in direction 56 or downwards in direction 58. Movement along the periphery of system 30 may be controlled by rotating guide bar system 40 around axis Z.

Figure 7:
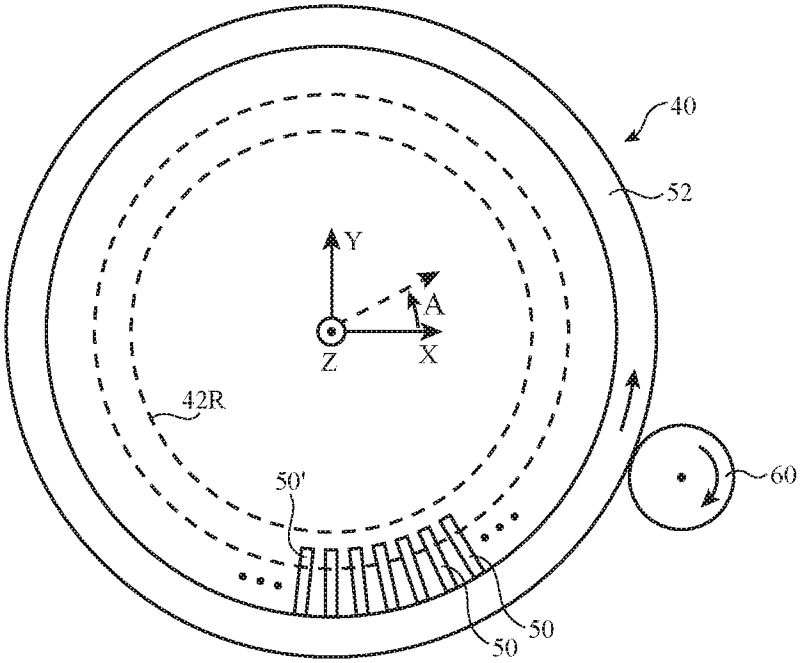
FIG. 7 is a top view of an illustrative guide system and an associated needle system in a warp knitting system in accordance with an embodiment.

Consider, as an example, the top view of guide bar system 40 that is shown in FIG. 7. As shown in FIG. 7, guide bars 50 may be distributed around the interior of guide bar support 52 and may face inwardly towards the Z axis. Needles 42 may have tips with hooks located in ring-shaped region 42R. Region 42R may be overlapped by tips 50' of guide bars 50. As shown in FIG. 7, the angular position of each guide bar 50 around axis Z can be adjusted by adjusting the angular position of guide bar support 52 around axis Z (e.g., by rotating guide bar support 52 and therefore guide bars 50 using guide bar system rotational positioner 60).

Figure 8:
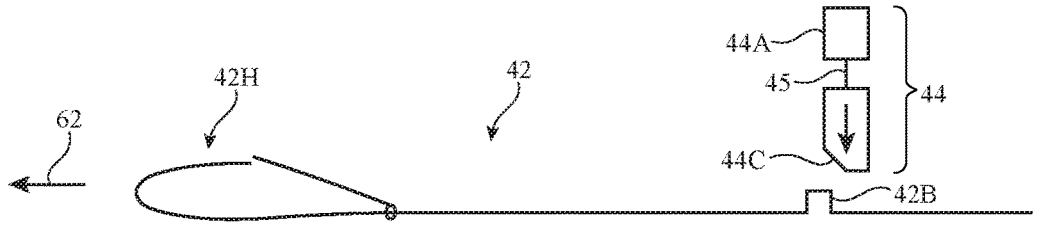
FIGS. 8 and 9 show illustrative needles and positioners for moving the needles in accordance with an embodiment.
Figure 9:
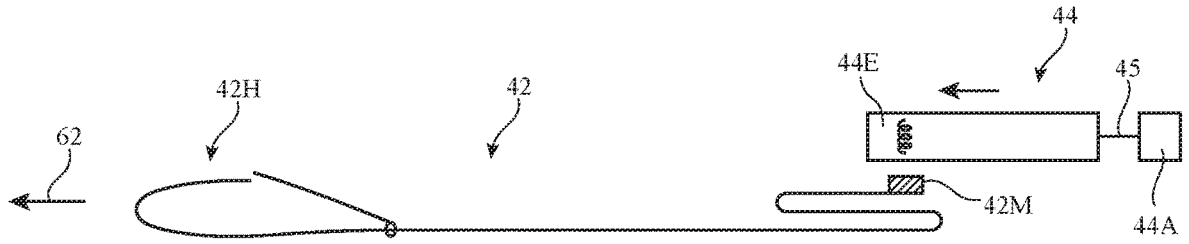

Needles 42 may have any suitable configuration. Illustrative latch needles (needles having hooks with latches such as hooks 42H) are shown in FIGS. 8 and 9. In the example of FIG. 8, needle positioner 44 includes cam 44C and electrically adjustable positioner 44A. Needle 42 of FIG. 8 can be moved in direction 62 by moving cam 44C against butt 42B of needle 42 with positioner 44A. In the example of FIG. 9, needle 42 has magnet 42M. Needle positioner 44 includes electrically controlled electromagnet 44E and electrically adjustable positioner 44A. Needle 42 may be moved in direction 62 by activating electromagnet 44E and moving electromagnet 44E in direction 62 with positioner 44A.

Coupling structures 45 may be used to couple positioner 44A to latch needle positioning structures such as cam 44C of FIG. 8 and movable electromagnet 44E. In general, any suitable coupling mechanism may be used in forming coupling structures 45 (e.g., pushrods, levers, moving wheels, gears with teeth, etc.). With one illustrative configuration, coupling structures 45 are formed from cables such as metal cables that slide in polymer sheaths, allowing actuators such as positioners 44A to be located away from needles 42. If desired, guiding structures such as pulleys can be used to help guide the cables. The cables can be any suitable length (e.g., at least 10 cm, at least 100 cm, at least 1000 cm, less than 500 cm, less than 40 cm, etc.). By using cables to form coupling structures 45, the lengths of the needles may be shortened and the diameter of the system can be reduced.

Figure 10:
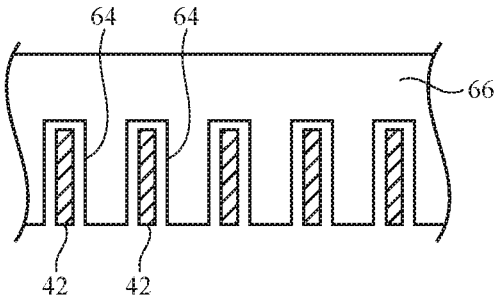
FIG. 10 is a top view of a portion of a needle bed in an illustrative needle system in accordance with an embodiment.
Figure 11:
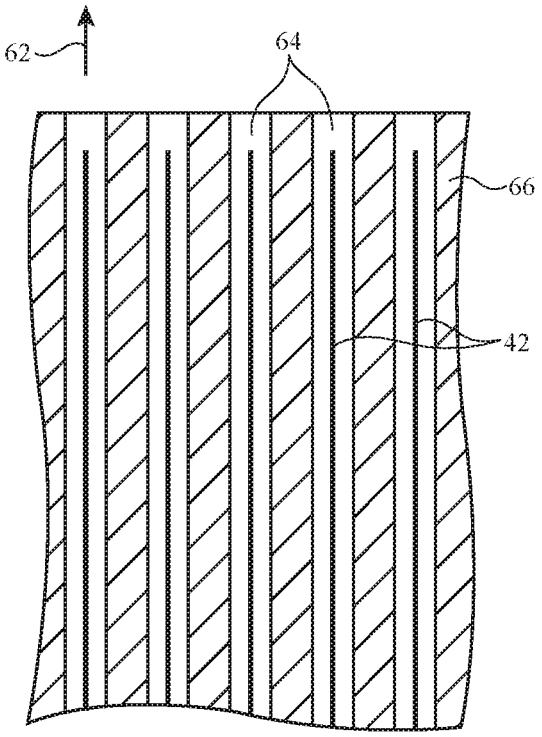
FIG. 11 is a side view of the illustrative needle bed of FIG. 10 in accordance with an embodiment.

FIG. 10 is an end view of an illustrative needle bed (sometimes referred to as a needle guide or needle guide structure). As shown in FIG. 10, needle bed 66 may have a series of needle guides 64 (sometimes referred to as needle guide grooves, needle guide slots, or needle tricks). FIG. 11 is a front view of the illustrative needle bed 66 of FIG. 10, showing how needles 42 may each lie within a respective one of the needle guide grooves 66. During operation (e.g., when needle positioner 44 is activated), the hooked ends of needles 42 may extend outwardly from needle bed 66 in direction 62 to engage strands 16 being provided by guide bars 50.

Figure 12:
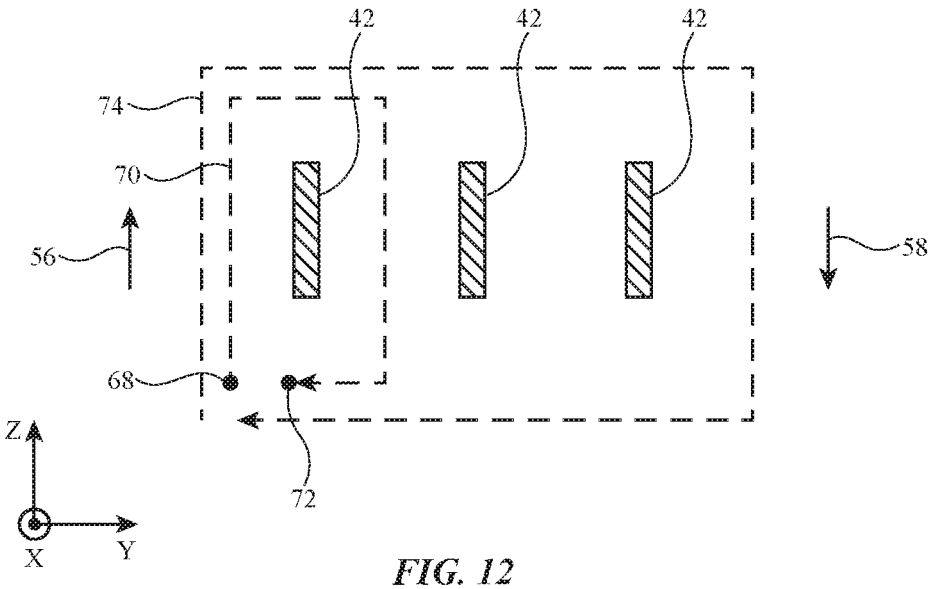
FIG. 12 is an end view of an illustrative set of needles showing illustrative guide bar paths around the needles in accordance with an embodiment.

Illustrative operations associated with dispensing a strand from a guide bar onto a needle is shown in FIG. 12. In a first scenario, strand 16 is moved around one of needles 42 following path 70. In a second scenario, strand 16 is moved around multiple needles 42 following path 74.

Consider, as an example, the first scenario. In this arrangement, the guide bar holding strand 16 initially has its eyelet 59 at start position 68. The guide bar positioner 54 for that guide bar 50 is then used to move eyelet 59 of that guide bar 50 upwards in direction 56 (e.g., in the +Z direction). This is followed by movement of guide bar 50 and its eyelet 59 to the right (in the +Y direction) by rotating guide bar support 52 with guide bar system rotational positioner 60 (e.g., by increasing rotational angle A). Guide bar positioner 54 may then move eyelet 59 downwards in direction 58 (e.g., in the —Z direction). Guide bar system 40 may then be rotated in the reverse direction (by using positioner 60 to rotate support 52 to decrease rotational angle A). As shown in FIG. 12, this moves strand 16 to position 72 at the end of path 70. Similar motions may be used in the second scenario to move strand 16 from position 68 to position 72 around three different needles 42 following path 74. Other strand movements may be achieved by dynamically adjusting strand guide bar system 40 with controller 46, if desired. The examples of FIG. 12 are illustrative.

Figure 13:
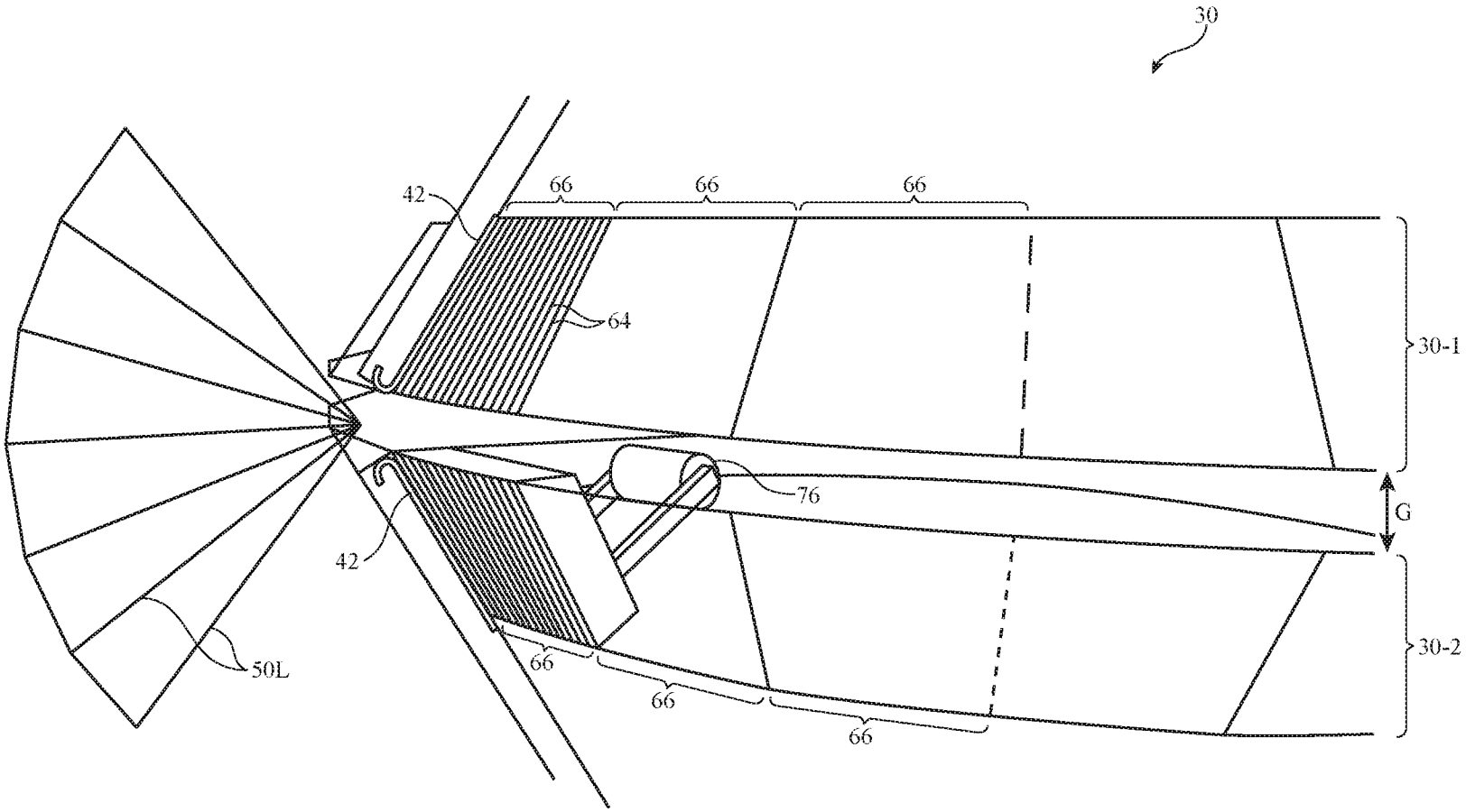
FIG. 13 is a perspective view of an illustrative knitting system in accordance with an embodiment.

FIG. 13 is a perspective view of a portion of system 30. As shown in FIG. 13, needles 42 may be guided by needle guide grooves 64 in needle beds 66. Guide bars 50 may be selectively arranged to align with lines such as lines 50L. During operation, a tube of knit fabric may pass through gap G between the needle guide system of portion 30-1 and the opposing needle guide system of portion 30-2 and be guided downwards through the center of system 30 (e.g., through an opening in the needle guide system of portion 30-2) using rollers such as roller 76.

Figure 14:
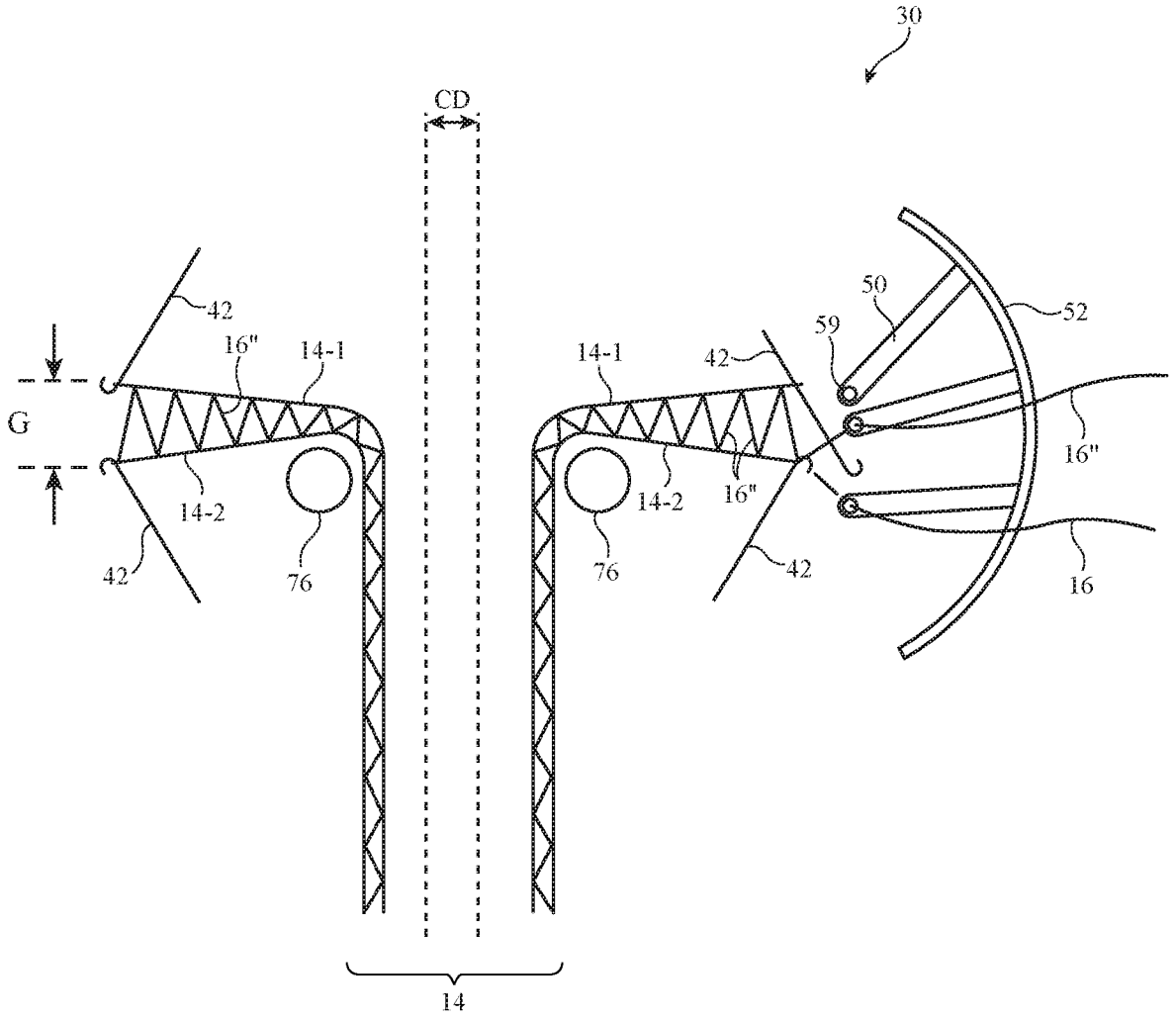
FIG. 14 is a side view of an illustrative knitting system in accordance with an embodiment.

The side view of system 30 of FIG. 14 shows how a seamless tubular fabric with a spacer layer may be warp knitted using system 30. As shown in FIG. 14, fabric 14 may include outer fabric layer 14-2 formed by needles 42 associated with outer (first) portion 30-1 of system 30 and may include inner fabric layer 14-1 formed by needles 42 associated with inner (second) portion 30-2 of system 30. Spacer strands 16" may be formed from monofilament (e.g., polymer monofilament fibers) and/or other strands of material. Each spacer strand 16" may be coupled alternately to one or more inner fabric layers such as inner fabric layer 14-1 and one or more outer fabric layers such as outer fabric layer 14-2.

As an example, as fabric 14 is being knit, a given spacer strand 16" may be coupled to a row of stiches in inner fabric layer 14-1. After additional rows of stiches have been formed in the inner fabric layer 14-1 (without coupling spacer strand 16' to those stitches), the spacer strand 16' may be coupled to a row of stitches in outer fabric layer 14-2. In this way, spacer strand 16' may oscillate back and forth between inner fabric layer 14-1 and outer fabric layer 14-2 to form a cushioning interior spacer layer in fabric 14. This provides fabric 14 with a soft cushioning feel when touched by the hand of a user (e.g., when a user picks up item 10 or otherwise interacts with item 10). At the same time, the circular symmetry of system 10 allows fabric 14 to be provided to take down system 36 as a continuous seamless tube of fabric. This tubular fabric, which may sometimes be referred to as a spacer fabric due to the presence of the spacer layer between outer layer(s) 14-2 and inner layer(s) 14-1, may be used as a fixed or removable cylindrical sleeve for an item with a cylindrical housing such as illustrative item 10 of FIG. 1 and/or may be incorporated into other fabric-based items.

Figure 15:
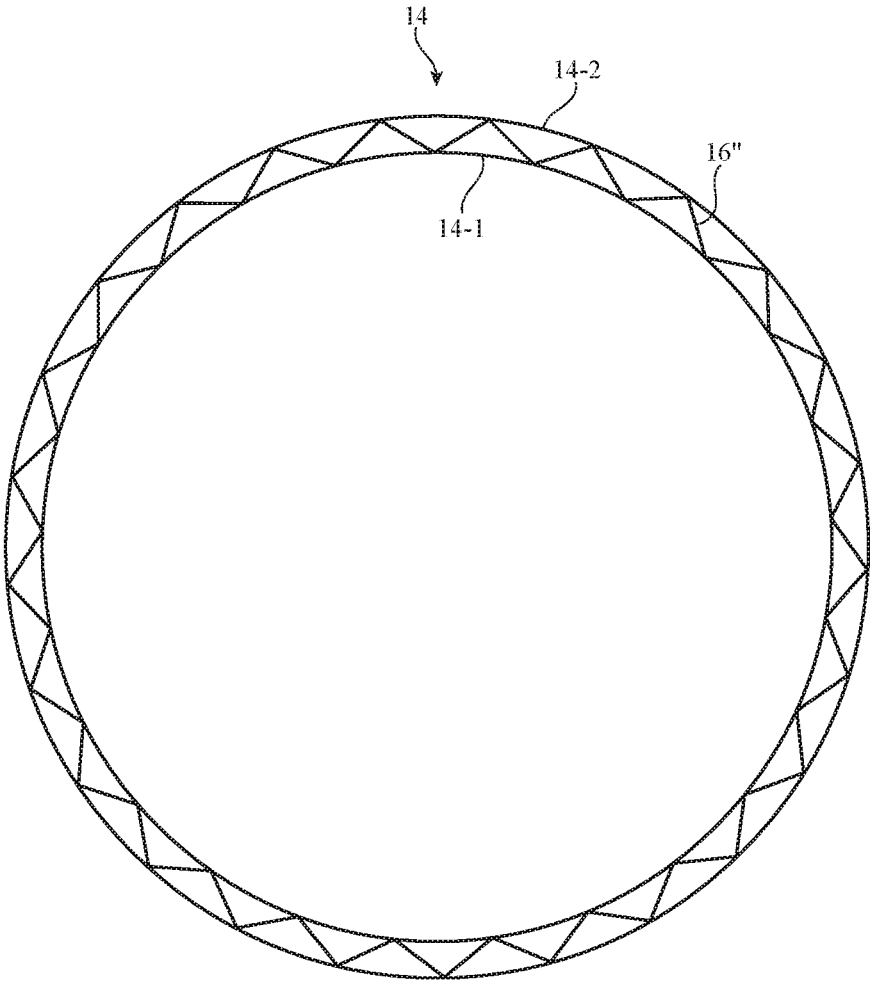
FIG. 15 is a top view of illustrative seamless tubular fabric having an internal spacer layer that separates inner and outer knit fabric layers from each other in accordance with an embodiment.

A top view of seamless warp knit tubular spacer fabric 14 is shown in FIG. 15, which shows how each spacer strand 16" alternated between being attached to a loop in outer fabric layer 14-2 and inner fabric layer 14-1. The thickness of fabric 14 between layers 14-1 and 14-2 (e.g., spacer thickness) can be adjusted by adjusting the magnitude of gap G between the needle systems of portions 30-1 and 30-2 in system 30 (see, e.g., FIG. 5). If G is larger, fabric 14 will be thicker. If G is smaller, fabric 14 will be thinner.

Figure 16:
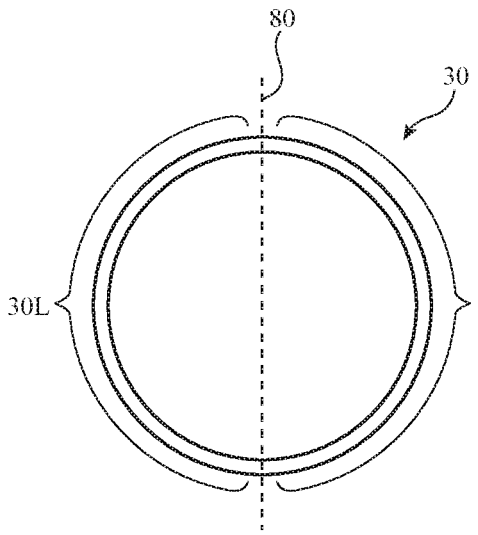
FIG. 16 is a top view of an illustrative knitting system configured to exhibit a circular outline in accordance with an embodiment.
Figure 17:
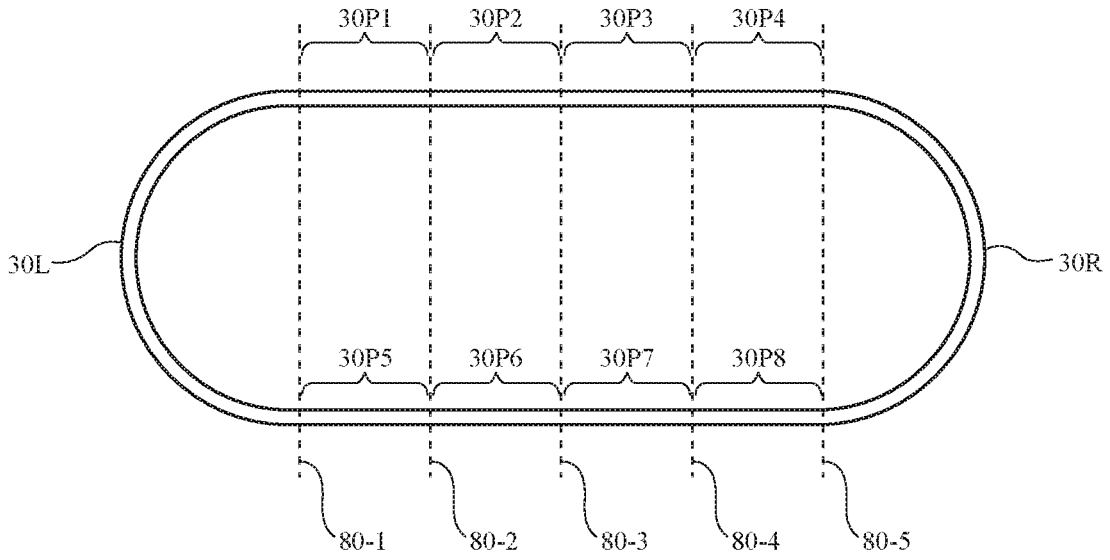
FIG. 17 is a top view of the illustrative knitting system of FIG. 16 that has been reconfigured to enhance its size (diameter) by incorporating additional sections in accordance with an embodiment.

FIGS. 16 and 17 show how selected sections of needle beds 66 and guide bar system 40 may be configured to form a knitting system of different sizes to produce fabric tubes of corresponding different diameters. In the example of FIG. 16, two circular half portions 30L and 30R of system 30 have been assembled along dividing line 80 to form a circular warp knitting system of the type shown in FIG. 5. In the example of FIG. 17, additional sections of system 30 have been added to enlarge the lateral dimensions of system 30 (e.g., to add more needles 42 and more corresponding guide bars 50 to enlarge system core diameter CD as shown in FIG. 14) and thereby enlarge the lateral dimensions (e.g., the tube diameter) of fabric tube 14. In general, any suitable number of additional sections may be added to system 30 (e.g., a first pair of sections 30P1 and 30P5 between lines 80-1 and 80-2, a second pair of sections 30P2 and 30P6 between lines 80-2 and 80-3, a third pair of sections 30P3 and 30P7 between lines 80-3 and 80-4, and/or a fourth pair of sections 30P4 and 30P8 between lines 80-4 and 80-5). Added sections may be straight and/or may be curved.

Figure 18:
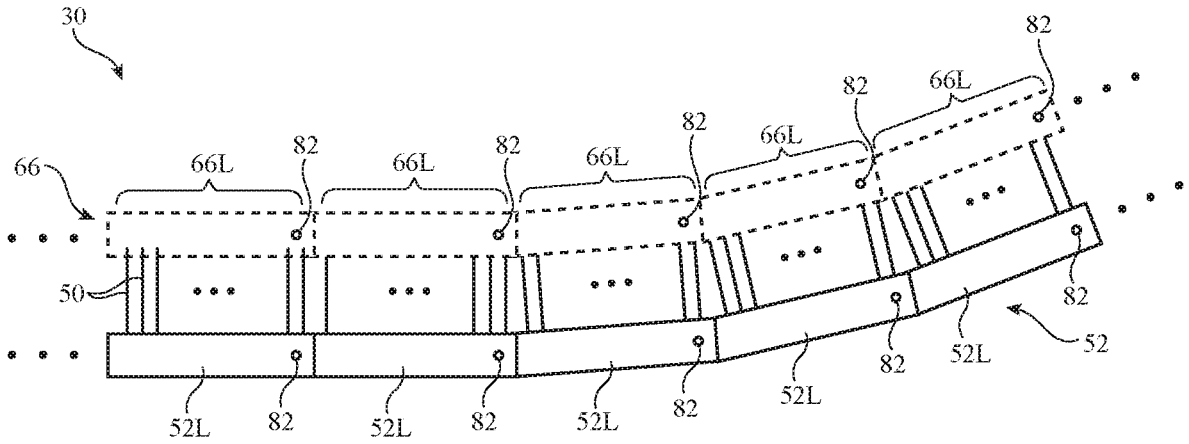
FIG. 18 is a top view of a portion of a guide and a portion of a needle bed in accordance with an embodiment.

FIG. 18 shows an illustrative configuration for accommodating additional sections of system 30. In the example of FIG. 18, guide bars 50 are supported by a segmented guide bar support structures (guide bar support links 52L) and needles 42 are supported by corresponding segmented needle bed structures (needle bed links 66L). Each section of guide bar system 40 such as link 52L may be coupled to multiple sets of guide bars 50. Each needle guide section such as needle guide link 66L may contain a corresponding set of needles 42. Links 66L may include a first set of links for supporting needles 42 in portion 30-1 and a second set of links for supporting needles 42 in portion 30-2. Links 52L and 66L may be joined by respective couplers 82 (e.g., removable pins, screws, magnets, springs, or other configurable coupling structures). During system configuration, a user of system 30 may select a desired size (number of needles, number of guide bars, etc.) for system 30 and may use couplers 82 to create corresponding linked chains from links 52L and 66L. For example, guide bar support structure 52 may be formed by coupling a desired number of links 52L together using couplers 82 and first and second needle bed chains may be formed by coupling desired numbers of links 66L together using couplers 82.

Figure 19:
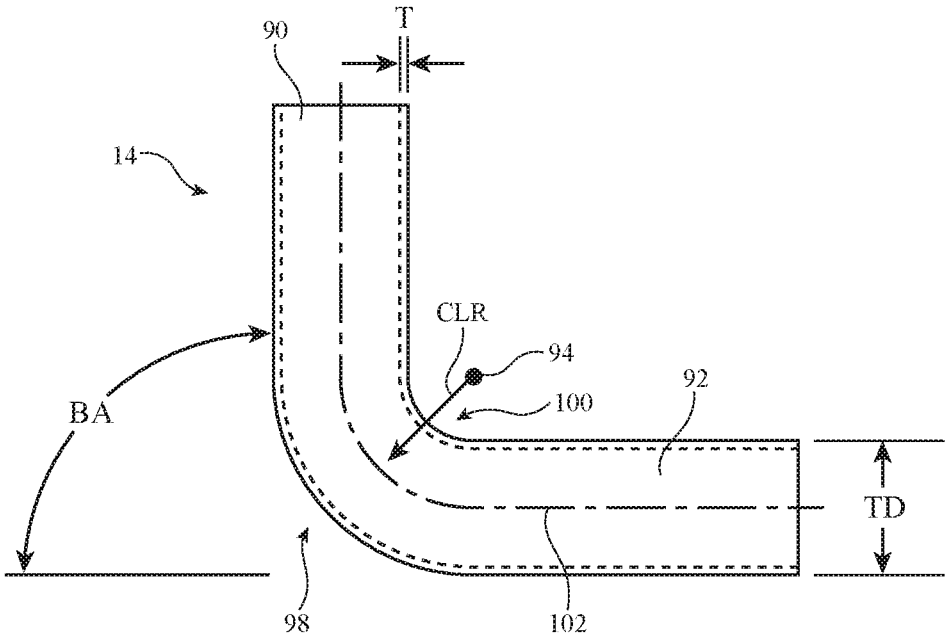
FIG. 19 is a side view of an illustrative tube of fabric in accordance with an embodiment.

The shape of knitted fabric tubes that are produced by system 30 may be adjusted to exhibit bends along their length and to produce sidewalls with desired cross-sectional profiles. FIG. 19 is a cross-sectional side view of an illustrative fabric tube with a longitudinal bend. As shown in FIG. 19, fabric 14 has the shape of a hollow tube having a hollow cylindrical interior 90 surrounded by a wall of fabric of thickness T. System 30 can be used to adjust the value of thickness T (e.g., by adjusting gap G, as described in connection with FIG. 14). System 30 can also be used to adjust the diameter TD of the tube (e.g., the diameter of hollow interior 90). In the example of FIG. 19, the tube of fabric 14 has a longitudinal bend (a bend along its length that causes a bend in its longitudinal axis 102) with a longitudinal bend angle BA. The value of angle BA may be 0-90°, a non-zero angle of less than 10°, less than 40°, less than 120°, less than 180°, at least 5°, at least 45°, at least 80°, at least 160°, or other suitable bend angle value. To accommodate bend angle BA of the bend in the fabric tube, the outer portion of the fabric tube at the bend (see, e.g., portion 94 of FIG. 19) may be provided with extra rows of loops relative to the inner portion of the fabric tube (see, e.g., portion 96). The inclusion of extra rows and/or selective removal of rows can be used to produce a tube with a desired centerline radius (e.g., a desired value of centerline radius CLR measured from point 94 to longitudinal axis 102 of the tube).

Figure 20:
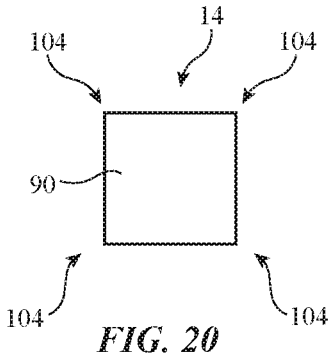
FIGS. 20, 21, and 22 are cross-sectional views of illustrative tubes of fabric in accordance with embodiments.
Figure 21:
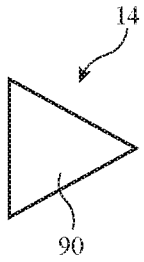
Figure 22:
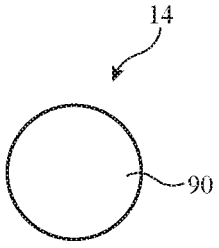
Figure 26:
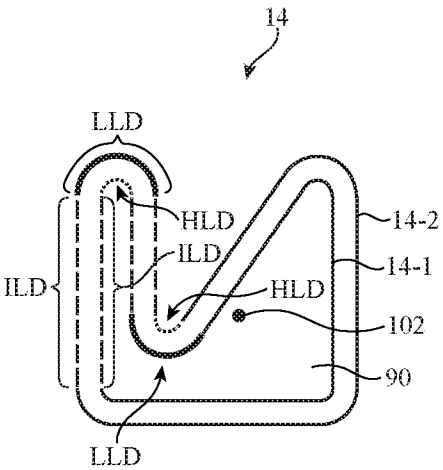
FIGS. 23, 24, 25, and 26 are cross-sectional side views of illustrative tubes of fabric with fabric layers that have been configured to produce bends in the cross-sectional profiles of the tubes in accordance with embodiments.
Figure 25:
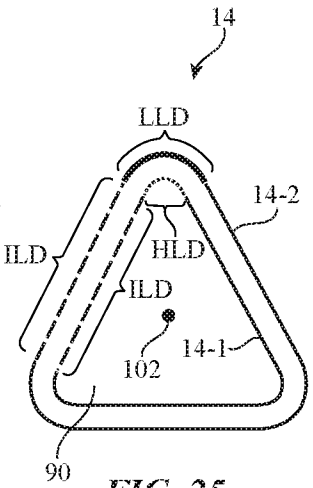

Stitch tightness (the size of stiches and therefore the density of stiches per length along a row of stiches) can also be adjusted selectively using system 30 along various portions of the walls of a fabric tube. For example, stitch tightness in a portion of a row of stiches can be loosened (reduced) in an outer layer of fabric 14 and stitch tightness can be tightened (increased) in a corresponding inner layer of fabric 14 when the fabric is being bent around the corner of a square tube (e.g., to accommodate corners such as the four right-angle corners 104 of the fabric tube shown in the cross-sectional profile of FIG. 20). FIGS. 21 and 22 show additional illustrative cross-sectional profiles that may be produced during knitting of the fabric tube by system 30. In general, any suitable cross-sectional tube profile may be produced during knitting. The configurations of FIGS. 20, 21, and 22 are illustrative.

The use of selective adjustments to stitch tightness in fabric 14 to produce tubes of fabric 14 with desired cross-sectional profiles is illustrated further in FIGS. 23, 24, 25, and 26. As shown in these diagrams, layers of fabric 14 (e.g., inner and/or outer layers) may be provided higher stitch tightness portions HLD, lower stitch tightness portions LLD, and/or intermediate stitch tightness portions ILD having stitch tightness values that lie between the high tightness values of portions HLD and the low tightness values of portions LLD. Portions HLD, LLD, and ILD may be distributed around the periphery of the fabric tube as needed to accommodate bends at corners and other curved and/or straight portions of the sidewalls of the tube of fabric. In this way, desired cross-sectional profiles with bends may be produced for the walls of fabric tubes produced by system 30.

Figure 24:
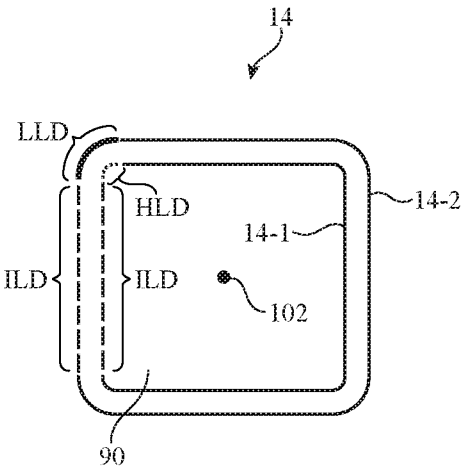
Figure 23:
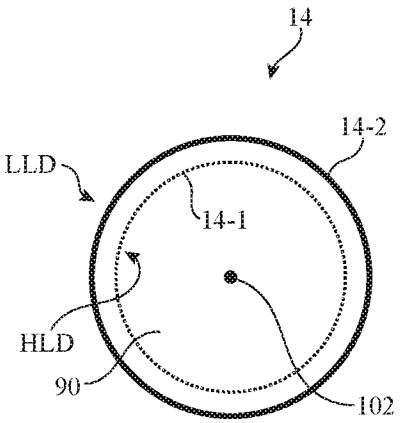

In the example of FIG. 23, inner fabric layer 14-1 of fabric 14 may have a higher stitch tightness (portion HLD) than outer fabric layer 14-2 (portion LLD) because inner fabric layer 14-1 has a smaller diameter than outer fabric layer 14-2. In the example of FIG. 24, the inner and outer fabric layers of planar sidewall portions of the tube have intermediate tightness portions ILD, because these layers run parallel to each other. At corners 104, inner layer 14-1 may have high tightness portion HLD and opposing outer layer 14-2 may have low tightness portion LLD. Similarly, varying stitch tightness values may be used along the rows of stiches (strand loops) in fabric 14 of FIGS. 25 and 26 to accommodate lateral bends (bends perpendicular to longitudinal tube axis 102) in fabric 14.

Figure 27:
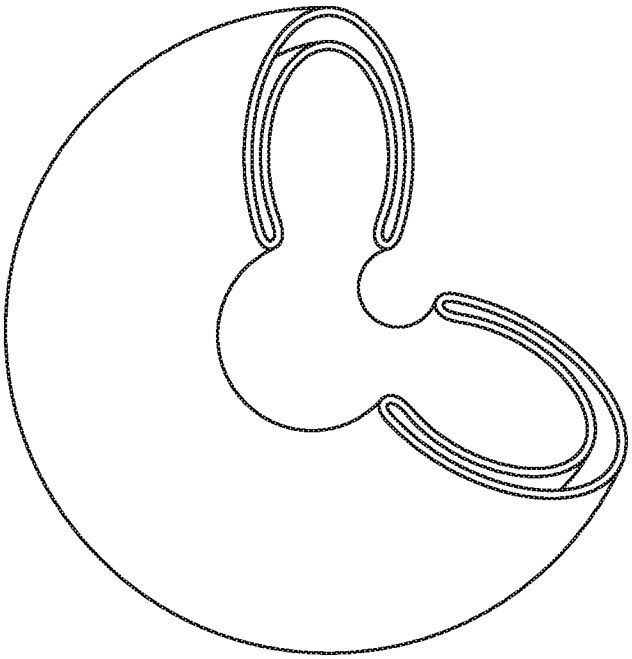
FIG. 27 is a perspective view of an illustrative warp knitted fabric structure in accordance with an embodiment.
Figure 28:
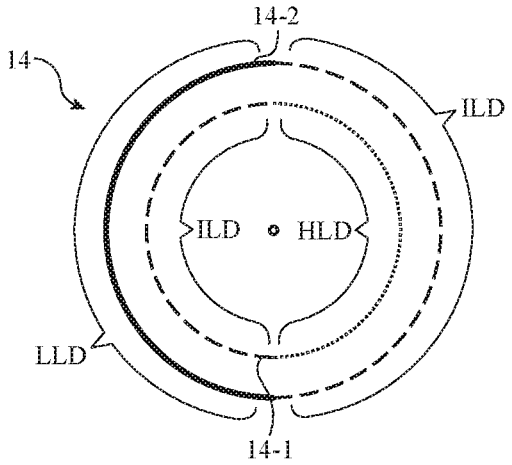
FIG. 28 is a cross-sectional side view of a tube of fabric of the type that may be configured to form a spiral tube in accordance with an embodiment.
Figure 29:
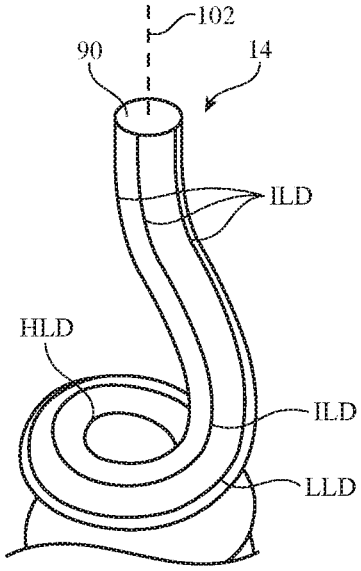
FIG. 29 is an illustrative spiral tube of fabric in accordance with an embodiment.

As shown in FIG. 27, a tube of fabric may be bent sufficiently along its longitudinal axis to form a C-shaped section of tubing (e.g., with sidewalls partially removed). This type of tubing may be used to form an enclosure (e.g., a case for headphones), a bag, a pair of head-mounted googles, and/or other suitable device structures (see, e.g., fabric 14 on housing 12 of item 10 of FIG. 1). A spiral tube may also be formed by creating localized variations in stitch tightness around the periphery of the tube and along the length of the tube, as shown in the cross-sectional tube profile of FIG. 28 and the perspective view of a corresponding tube with spiral structures of FIG. 29.

The foregoing is merely illustrative and various modifications can be made to the described embodiments. The foregoing embodiments may be implemented individually or in any combination.

What is claimed is:

1. A fabric-based item comprising:

a housing having a sidewall surface and an upper surface;

a seamless tube of warp knit fabric having an inner warp knit layer and an outer warp knit layer and having a warp knit spacer layer between the inner and outer warp knit layers that is alternately coupled to inner stitch rows in the inner warp knit layer and outer stitch rows in the outer warp knit layer, wherein each inner stitch row and outer stitch row to which the spacer layer is coupled are separated by at least one row of stitches, and wherein the seamless tube of warp knit fabric covers the sidewall surface and a portion of the upper surface; and electrical components mounted in the housing.

2. The fabric-based item defined in claim 1 wherein the electrical components include a speaker and wherein the seamless tube of warp knit fabric forms a covering layer that is permeable to sound and that surrounds the speaker, wherein the warp knit spacer layer is formed from warp knit monofilaments, and wherein the inner and outer warp knit layers are formed from warp knit multifilament yarns.

3. The fabric-based item defined in claim 2 wherein the seamless tube of warp knit fabric includes an array of openings.

4. The fabric-based item defined in claim 3 further comprising a cylindrical support structure covered by the seamless tube of warp knit fabric.

5. The fabric-based item defined in claim 1 wherein the warp knit spacer layer is formed from warp knit monofilaments.

6. The fabric-based item defined in claim 1 wherein the inner and outer warp knit layers are formed from warp knit multifilament yarns and wherein the electrical components comprise wireless communications circuitry.

7. The fabric-based item defined in claim 1 wherein the seamless tube of warp knit fabric has a circular cross-sectional profile.

8. The fabric-based item defined in claim 7 wherein the inner warp knit layer has a first stitch size and wherein the outer warp knit layer has a second stitch size that is greater than the first stitch size.

9. The fabric-based item defined in claim 1 wherein the seamless tube of warp knit fabric has a cross-sectional profile with a corner portion and a planar portion.

10. The fabric-based item defined in claim 9 wherein the inner warp knit layer has a first stitch size at the planar portion and a second stitch size at the corner portion, wherein the outer warp knit layer has the first stitch size at the planar portion and a third stitch size at the corner portion, and wherein the first stitch size is greater than the second stitch size and the third stitch size is greater than the first stitch size.

11. The fabric-based item defined in claim 1 wherein the inner and outer warp knit layers are formed from strands formed from a material selected from the group consisting of polymer, metal, glass, graphite, ceramic, cotton and bamboo.

12. The fabric-based item defined in claim 1 wherein the inner and outer warp knit layers are formed from strands formed from non-conductive material coated with conductive material.

13. The fabric-based item defined in claim 1 wherein the seamless tube of warp knit fabric is bent along a longitudinal axis to form a C-shaped cross section.

14. The fabric-based item defined in claim 1 wherein the warp knit spacer layer is formed from multifilament strands coupled to loops.

15. A fabric-based item, comprising:

a seamless tube of warp knit fabric, comprising:

an inner warp knit layer with a first diameter formed from a first stitch size;

an outer warp knit layer with a second diameter formed from a second stitch size, wherein the second diameter is larger than the first diameter and the second stitch size is larger than the first stitch size; and a warp knit spacer layer between the inner and outer warp knit layers that is alternately coupled to the inner warp knit layer and the outer warp knit layer; and electrical circuitry.

16. The fabric-based item defined in claim 15 further comprising a support structure covered by the seamless tube of warp knit fabric, wherein the electrical circuitry is mounted within the support structure.

17. The fabric-based item defined in claim 16 wherein the electrical circuitry comprises wireless communications circuitry.

18. A fabric-based item comprising:

a seamless tube of fabric having an inner warp knit layer and an outer warp knit layer and having a warp knit spacer layer between the inner and outer warp knit layers that is alternately coupled to loops in the inner warp knit layer and loops in the outer warp knit layer, wherein the seamless tube of fabric has an upper portion, a lower portion, and sidewall portions that extend from the upper portion to the lower portion, wherein the sidewall portions have first and second regions, wherein the inner warp knit layer has a first stitch size at the first region and a second stitch size at the second region, wherein the outer warp knit layer has the first stitch size at the first region and a third stitch size at the second region, and wherein the first stitch size is greater than the second stitch size and the third stitch size is greater than the first stitch size; and a speaker interposed between the upper portion and the lower portion.

19. The fabric-based item defined in claim 18 further comprising a plastic support structure covered by the seamless tube of warp knit fabric, wherein the speaker is mounted in the plastic support structure.

20. The fabric-based item defined in claim 19 wherein the seamless tube of warp knit fabric is permeable to sound and has a circular cross-sectional profile.

* * * * *